US012310511B2

(12) United States Patent
Zhang

(10) Patent No.: US 12,310,511 B2
(45) Date of Patent: May 27, 2025

(54) FOLDABLE CHAIR FRAME WITH ARMRESTS

(71) Applicant: Fujian Sunwee Outdoor Co., Ltd., Fujian (CN)

(72) Inventor: Dexing Zhang, Fujian (CN)

( * ) Notice: Subject to any disclaimer, the term of this patent is extended or adjusted under 35 U.S.C. 154(b) by 222 days.

(21) Appl. No.: 18/144,845

(22) Filed: May 8, 2023

(65) Prior Publication Data

US 2024/0188717 A1 Jun. 13, 2024

(30) Foreign Application Priority Data

Dec. 8, 2022 (CN) ..... 202223297315.6

(51) Int. Cl.
*A47C 4/28* (2006.01)

(52) U.S. Cl.
CPC ..... *A47C 4/286* (2013.01)

(58) Field of Classification Search
CPC ..... A47C 4/286
See application file for complete search history.

(56) References Cited

U.S. PATENT DOCUMENTS

2015/0359339 A1* 12/2015 Choi ..... A47C 4/286 297/42
2022/0248855 A1* 8/2022 Chen ..... A47C 4/286
2023/0232984 A1* 7/2023 Frankel ..... A47C 4/286 297/38

FOREIGN PATENT DOCUMENTS

CN 201119600 Y * 9/2008 ..... A47C 4/286
CN 215837985 U * 2/2022 ..... A47C 4/286

* cited by examiner

*Primary Examiner* — Anthony D Barfield

(57) ABSTRACT

A foldable chair frame with armrests, having two frames; each frame contains a backrest rod, an oblique supporting rod, a seat rod and an armrest supporting rod; upper end of the oblique supporting rod is pivotal to the backrest rod; lower end of the armrest supporting rod is slidably connected to the oblique supporting rod; the seat rod is pivotal to both the backrest rod and the oblique supporting rod; an armrest rod is given between the backrest rod and the armrest supporting rod; the armrest rod has a front end pivotal to an upper end of the armrest supporting rod and a rear end connected with a supporting piece which is pivotal to the backrest rod and positioned below a rear connecting seat; a sliding groove is opened at the bottom of the armrest rod allowing a position limiting portion of the supporting piece to be limited there and slidable therein when the armrest rod is folded or unfolded.

8 Claims, 5 Drawing Sheets

FOLDABLE CHAIR FRAME WITH ARMRESTS

BACKGROUND OF THE INVENTION

The present invention relates to the technical field of chairs, and more particularly to a foldable chair frame with armrests.

For the purpose of portability and less occupation of space of a chair, foldable chair is invented. Foldable chair is now widely used in people's daily lives as well as in offices. A foldable frame in the prior art usually comprises a foldable chair frame and a fabric mounted on the chair frame to serve as the seat and the backrest. To increase comfortability, armrests are usually fixedly provided on the chair frame. Due to unsatisfied demands in case of soft armrests, some foldable chairs are provided with hard armrests.

Some armrests in the prior art are fixed to the chair frame, and so they are required to be dismounted entirely from the chair frame or at least one end of which should be dismounted from the chair frame in order to fold the chair frame. Such an operation is very inconvenient. Some armrests of a foldable chair have to be rotated upward or downward together with the supporting legs of the chair frame when the chair frame is folded or unfolded. In order to allow folding, connecting parts of the armrests with the chair frame have to be formed with cut-out portions to allow folding, like the foldable chair disclosed in CN203041399U or the foldable chair with armrests disclosed in CN208875754U, and these armrests being disclosed are complicated in structures and may easily result in improper folding and unfolding during use of the foldable chair, thereby obstructing the folding and unfolding operation of the foldable chair; since the armrests cannot smoothly folded and unfolded together with the chair frame, user's experience is bad. In some foldable chairs, some supporting structures have to be additionally provided to support the armrests in addition to the original structures of the foldable chairs, or some kinds of sliding seats have to be provided for the armrests, in order to facilitate the folding and unfolding of the armrests, but these may only complicate the structures of the armrests and increase the costs of designing molds during production. Therefore, the technical objectives of the present invention are to provide a foldable chair with a simpler overall structure and which contains armrests to be folded and unfolded smoothly together with the foldable chair without the need of significantly altering the original structures of the foldable chair.

BRIEF SUMMARY OF THE INVENTION

In view of the aforesaid disadvantages now present in the prior art, it is an object of the present invention to provide a foldable chair frame with a simple overall structure and which contains armrests to be folded and unfolded smoothly together with the foldable chair frame.

To achieve the above object, the present invention provides the following technical solutions:

A foldable chair frame with armrests; wherein the foldable chair frame comprises two frames symmetrically to each other and arranged oppositely with respect to each other, one of which being a left frame of the foldable chair frame, and another one being a right frame of the foldable chair frame; a front cross rod assembly and a rear cross rod assembly are disposed between the two frames; the front cross rod assembly is pivotally connected to front parts of the two frames so as to be rotatable with respect to the two frames; the rear cross rod assembly is pivotally connected to rear parts of the two frames so as to be rotatable with respect to the two frames; each of the two frames comprises a backrest rod, an oblique supporting rod, a seat rod, and an armrest supporting rod, an upper end of the oblique supporting rod is pivotally connected with a rear connecting seat which is slidable on the backrest rod, a lower end of the armrest supporting rod is slidably connected to the oblique supporting rod, the seat rod is pivotally connected to both the backrest rod and the oblique supporting rod; wherein, an armrest rod is provided between each backrest rod and a corresponding armrest supporting rod disposed in front of the backrest rod;

in each of the two frames, a front end of the armrest rod is pivotally connected to an upper end of the armrest supporting rod, a rear end of the armrest rod is connected to a supporting piece, and the supporting piece is pivotally connected to the backrest rod and positioned below the rear connecting seat; a bottom side of the armrest rod is provided with a sliding groove, the supporting piece is provided with a position limiting portion slidably limited in the sliding groove, when the armrest rod is being folded or unfolded together with folding or unfolding operation of the foldable chair frame, the position limiting portion slides in the sliding groove.

In each of the two frames, the supporting piece comprises a connecting portion and said position limiting portion disposed on one end portion of the connecting portion; the connecting portion is connected to the backrest rod by pivotal connection; the position limiting portion comprises a supporting base and a sliding block provided on the supporting base; the sliding block is fitted into the sliding groove of the armrest rod; when the sliding block is fitted into the sliding groove, the supporting base is neighboring to a bottom surface of the sliding groove.

The armrest rod is formed as a hollow rod; a bottom surface of the armrest rod is provided with an opening through which the sliding block is inserted into the sliding groove and being limited within the sliding groove; the sliding block comprises wings extending oppositely with respect to each other above the supporting base towards a widthwise direction of the sliding groove; the sliding groove comprises sliding rails extending into the sliding groove from two sides of the opening to support the wings; the wings are supported on the sliding rails and slidable on the sliding rails.

The armrest rod is curved at a middle portion thereof, such that the armrest rod has an overall curve shape; the sliding rails are limited within the supporting base and the wings.

Two end surfaces of the armrest rod are provided with end caps which limit a stroke of the sliding block sliding on the sliding rails.

The rear cross rod assembly comprises two first branch rods arranged in a cross shape and pivotally connected to each other; the front cross rod assembly comprises two second branch rods arranged in a cross shape and pivotally connected to each other; an upper end of each of the two first branch rods is pivotally connected to the rear connecting seat of a corresponding backrest rod; an upper end of each of the two second branch rods is pivotally connected to a front connecting seat; and each front connecting seat is connected and to a corresponding armrest supporting rod of a corresponding frame; a front portion of each seat rod of each frame rests on a corresponding front connecting seat.

An upper portion of each armrest supporting rod is bent outwardly to form a bent portion, and the bent portion is located above the corresponding front connecting seat.

A lower portion of the oblique supporting rod of each of the two frames is provided with a slider slidably provided on the oblique supporting rod, and the slider is located on the oblique supporting rod at a position above a position on the oblique supporting rod pivotally connected to a lower end of a corresponding second branch rod, each slider comprises a U-shaped block, and the lower end of the corresponding armrest supporting rod is pivotally connected to the U-shaped block.

According to the structures disclosed above, a supporting piece is additionally provided on each of the backrest rod in the present invention. The supporting piece supports a rear end of a corresponding armrest rod. Besides, each supporting piece is also provided with a position limiting portion which is limited and slidable within a sliding groove at a bottom of the corresponding armrest rod. As such, the armrest rods of the present invention can fold and unfold simultaneously with folding and unfolding of the foldable chair frame. The foldable chair frame of the present invention has a simple structure. On the basis that the original structures of a prior art foldable chair are not required to be changed, only the supporting pieces are additionally required to slide within the sliding grooves at the bottom of the armrest rods, the armrest rods and the foldable chair frame can be folded and unfolded as a whole. Therefore, the foldable chair frame of the present invention is convenient to use, and involves a lower cost of production.

REFERENCES IN THE FIGURES

Figure 1:
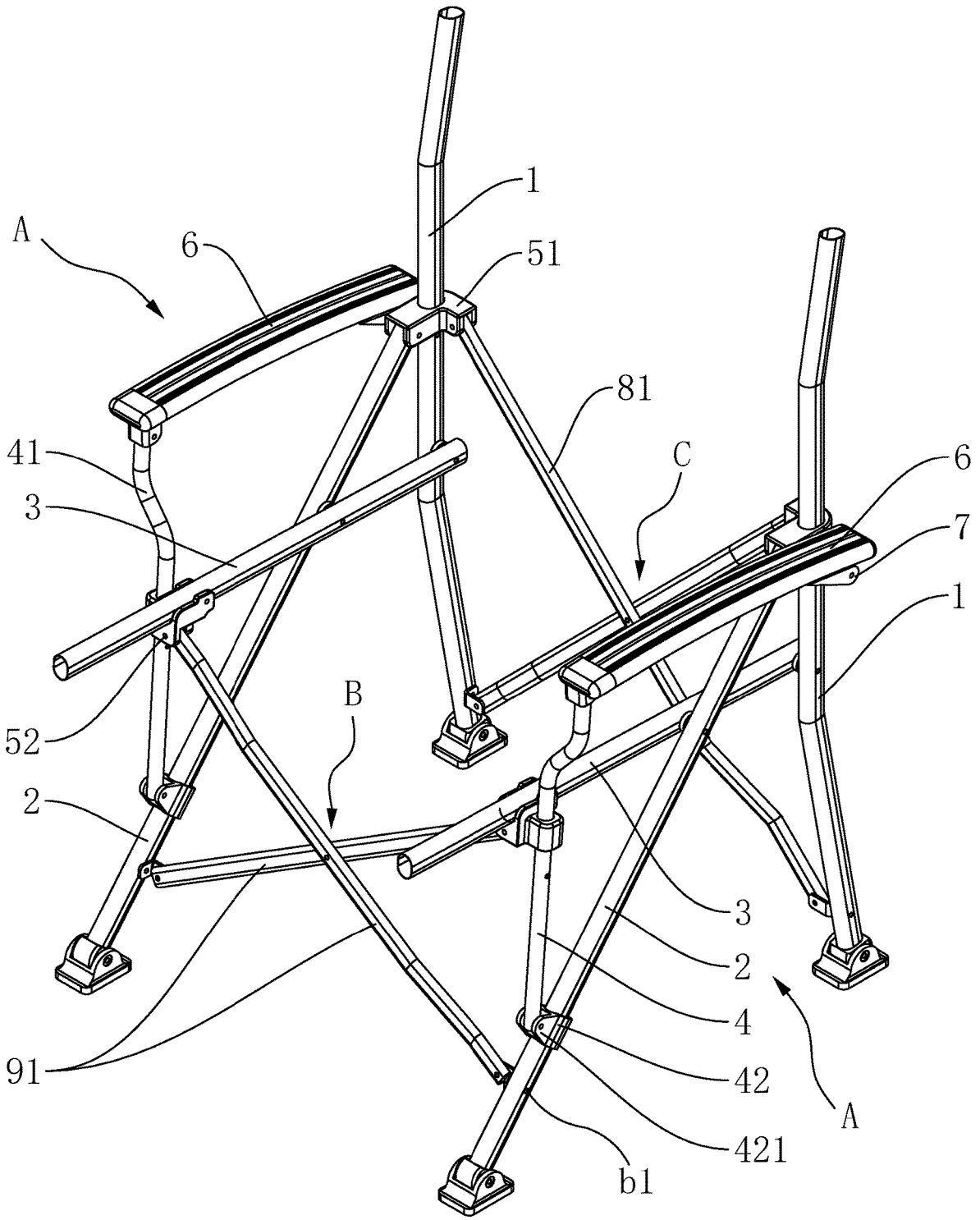
FIG. 1 is a perspective structural view of the present invention.
Figure 2:
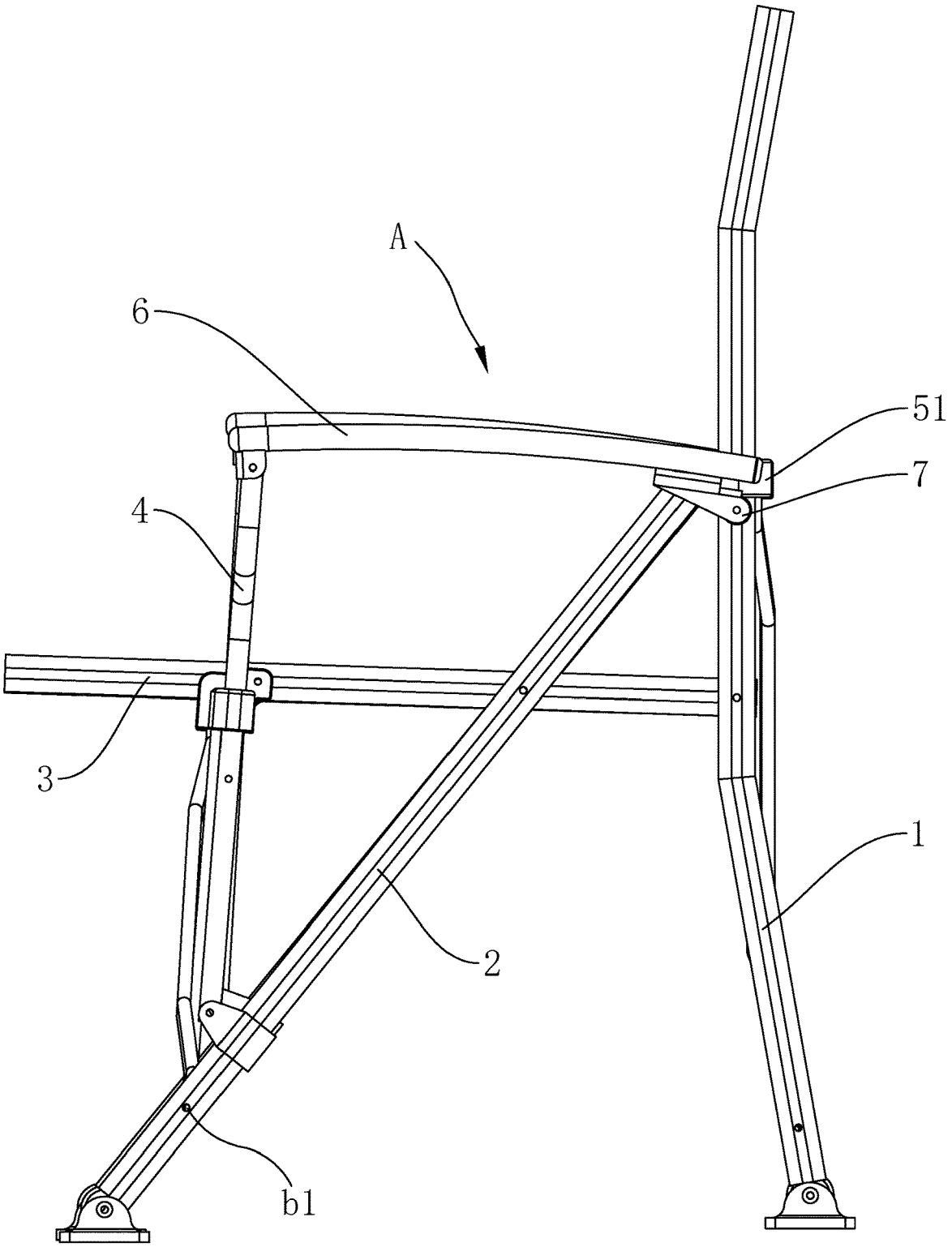
FIG. 2 is a side view of the present invention.

A: frame; B: front cross rod assembly; C: rear cross rod assembly; b1: a position on the oblique supporting rod which is pivotally connected to a lower end of a corresponding second branch rod; 1: backrest rod; 2: oblique supporting rod; 3: seat rod; 4: armrest supporting rod; 41: bent portion; 42: slider; 421: U-shaped block; 51: rear connecting seat; 52: front connecting seat; 6: armrest rod; 61: sliding groove; 610: opening; 611: sliding rail; 62: end cap; 7: supporting piece; 71: connecting portion; 72: position limiting portion; 721: supporting base; 722: sliding block; 7221; wing; 81: first branch rod; 91: second branch rod.

DETAILED DESCRIPTION OF THE INVENTION

To understand the technical scheme of the present invention, the present invention is further described in detail below with reference to an embodiment.

With reference to FIG. 1 to FIG. 5, the present invention discloses a foldable chair frame with armrests; wherein the foldable chair frame comprises two frames A symmetrically to each other and arranged oppositely with respect to each other, one of which being a left frame of the foldable chair frame, and another one being a right frame of the foldable chair frame; a front cross rod assembly B and a rear cross rod assembly C are disposed between the two frames A; the front cross rod assembly B is pivotally connected to front parts of the two frames A so as to be rotatable with respect to the two frames A; the rear cross rod assembly C is pivotally connected to rear parts of the two frames A so as to be rotatable with respect to the two frames A. Each of the two frames A comprises a backrest rod 1, an oblique supporting rod 2, a seat rod 3, and an armrest supporting rod 4, an upper end of the oblique supporting rod 2 is pivotally connected with a rear connecting seat 51 which is slidable on the backrest rod 1, a lower end of the armrest supporting rod 4 is slidably connected to the oblique supporting rod 2, the seat rod 3 is pivotally connected to both the backrest rod 1 and the oblique supporting rod 2; an armrest rod 6 is provided between each backrest rod 1 and a corresponding armrest supporting rod 4 disposed in front of the backrest rod 1.

Specifically, the rear cross rod assembly C is pivotally connected to both backrest rods 1 of the two frames A; the rear cross rod assembly C comprises two first branch rods 81 arranged in a cross shape and pivotally connected to each other; an upper end of each of the two first branch rods 81 is pivotally connected to the rear connecting seat 51 of a corresponding backrest rod 1 respectively; a lower end of each of the two first branch rods 81 is pivotally connected to a corresponding backrest rod 1 respectively proximal to a lower end of the corresponding backrest rod 1. The front cross rod assembly B is pivotally connected to front portions of both oblique supporting rods 2 of the two frames A; the front cross rod assembly B comprises two second branch rods 91 arranged in a cross shape and pivotally connected to each other; an upper end of each of the two second branch rods 91 is pivotally connected to a front connecting seat 52 respectively, and each front connecting seat 52 is connected and may also be fixed to a corresponding armrest supporting rod 4 of a corresponding frame A; a front portion of each seat rod 3 of each frame A rests on a corresponding front connecting seat 52, an upper portion of each armrest supporting rod 4 is bent outwardly to form a bent portion 41, and the bent portion 41 is located above the corresponding front connecting seat 52, so that each armrest rod 6 is positioned outside a chair seat for the purpose of ergonomic design suitable for resting an arm when a user is seated. In order that each armrest supporting rod 4 is in cooperation with a corresponding armrest rod 6 when the chair frame is folded, a lower portion of the oblique supporting rod 2 of each of the two frames A is provided with a slider 42 slidably provided on the oblique supporting rod 2, and the slider 42 is located on the oblique supporting rod 2 at a position above a position b1 on the oblique supporting rod 2 pivotally connected to a lower end of a corresponding second branch rod 91, so that sliding of the slider 42 above the position b1 on the oblique supporting rod 2 will not be obstructed. Each slider 42 comprises a U-shaped block 421, and the lower end of the corresponding armrest supporting rod 4 is pivotally connected to the U-shaped block 421. During use of the chair frame, a fabric (not shown in the figures) serving as a seat and a backrest of the chair can be removably mounted to the foldable chair frame, wherein a portion of the fabric serving as the seat is mounted between both seat rods 3 of the two frames A, and a portion of the fabric serving as the backrest is mounted between both backrest rods 1 of the two frames A. The portion of the fabric serving as the seat and the portion of the fabric serving as the backrest are formed as a one whole piece of fabric. The fabric can be folded and unfolded together with the folding and unfolding of the foldable chair frame. The foldable chair frame described above has a simple and stable structure, and facilitates more convenient assembly and disassembly of the same.

Further, in order that both armrest rods 6 can be directly folded together with the folding of the foldable chair frame, in each of the two frames A, a front end of the armrest rod 6 is pivotally connected to an upper end of the armrest supporting rod 4, a rear end of the armrest rod 6 is connected to a supporting piece 7, and the supporting piece 7 is pivotally connected to the backrest rod 1 and positioned below the rear connecting seat 51 so as not to obstruct the sliding of the rear connecting seat 51 above the supporting piece on the backrest rod 1, a bottom side of the armrest rod 6 is provided with a sliding groove 61, the supporting piece 7 is provided with a position limiting portion 72 slidably limited in the sliding groove 61, when the armrest rod 6 is being folded or unfolded together with folding or unfolding operation of the foldable chair frame, the position limiting portion 72 can slide in the sliding groove 61, so that the armrest rod 6 may be folded or unfolded in accordance with the folding or unfolding operation of the foldable chair frame without the need of adding other auxiliary structures on the foldable chair frame or one the armrest rod 6.

Figure 3:
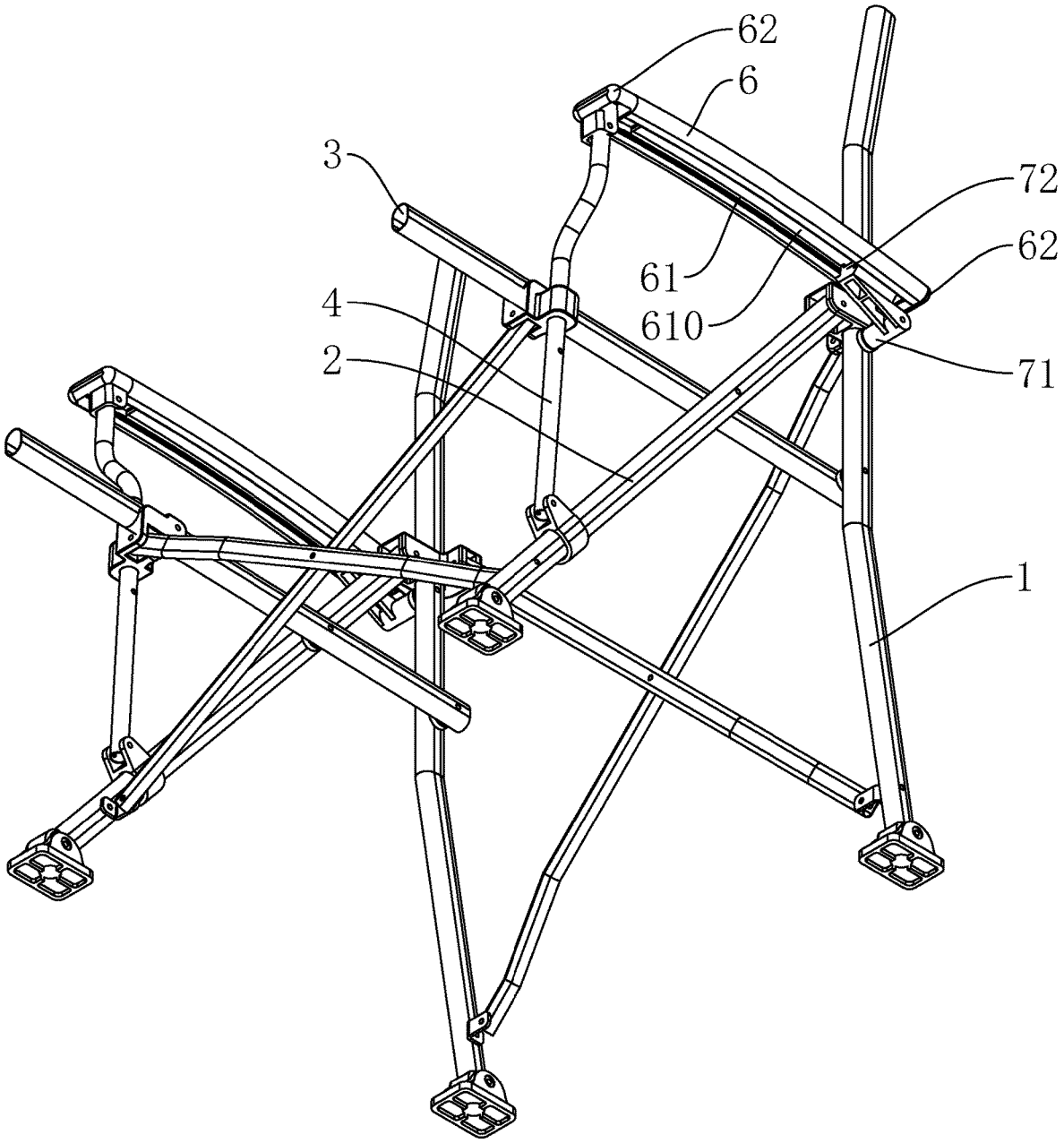
FIG. 3 is a bottom perspective view of the present invention.
Figure 4:
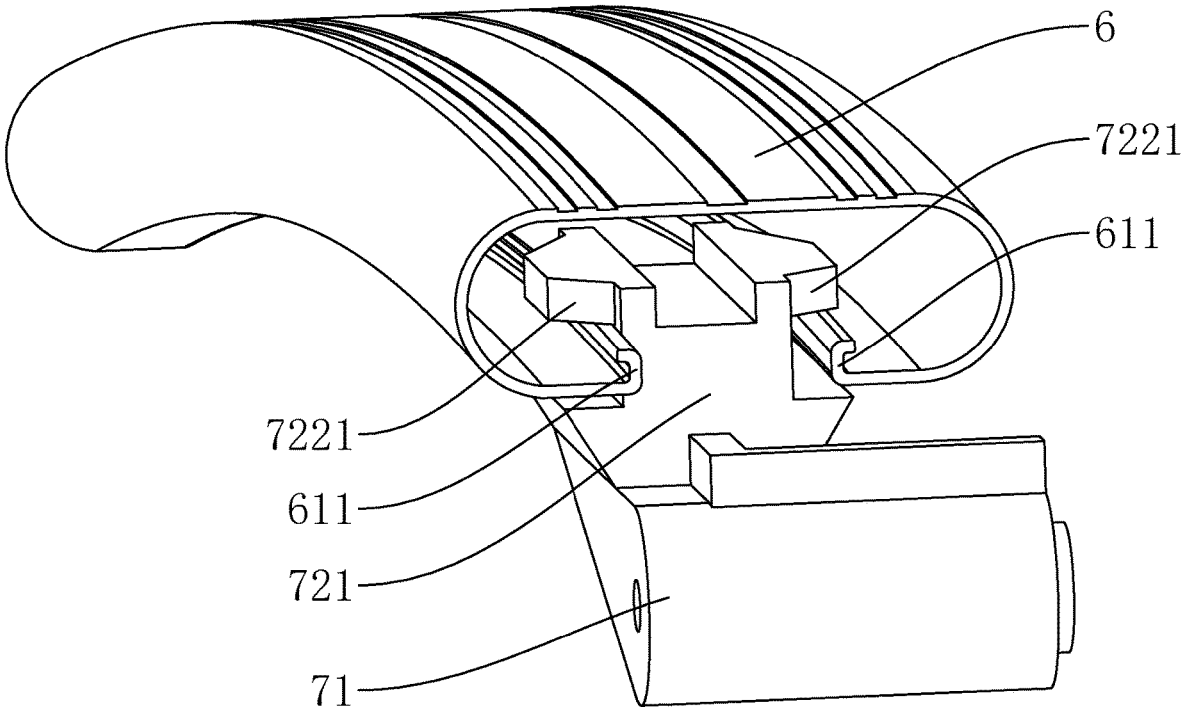
FIG. 4 is a structural view showing a supporting piece and a corresponding armrest rod.
Figure 5:
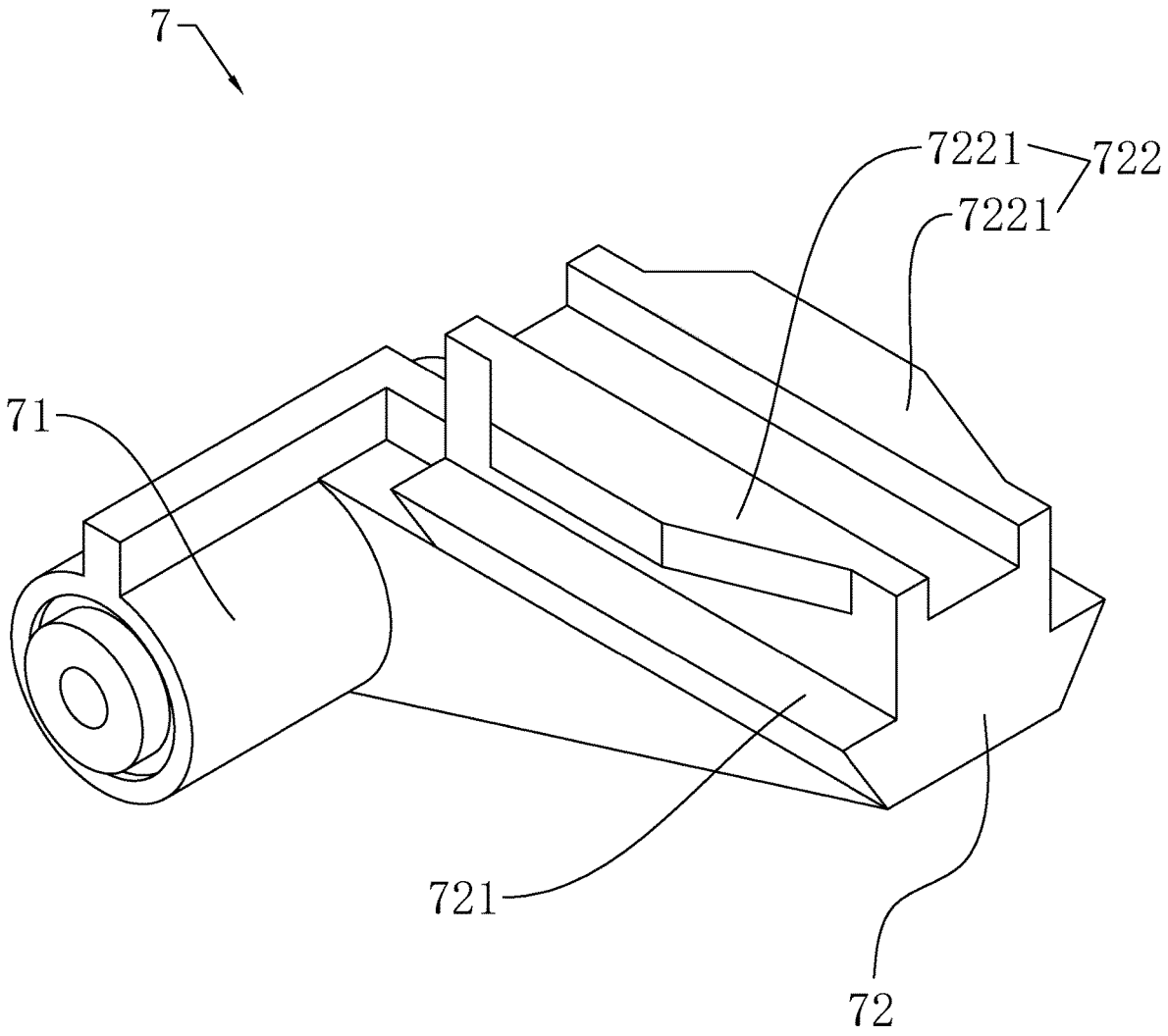
FIG. 5 is a structural view of the supporting piece.

Specifically, with reference to FIG. 3 to FIG. 5, in each of the two frames A, the supporting piece 7 comprises a connecting portion 71 and said position limiting portion 72 disposed on one end portion of the connecting portion 71; the connecting portion 71 is directly connected to the backrest rod 1 by pivotal connection; the connecting portion 71 is capable of rotating upwardly; the position limiting portion 72 extends perpendicularly from said one end portion of the connecting portion 71, so as to be in cooperative relationship with the design that the armrest rod 6 is positioned outside of the seat rod 3 (i.e. outside the chair seat); the front end of the armrest rod 6 is connected to the bent portion 41 disposed at the upper portion of the supporting rod 4; the position limiting portion 72 comprises a supporting base 721 and a sliding block 722 provided on the supporting base 721; the sliding block 722 is fitted into the sliding groove 61 of the armrest rod 6; when the sliding block 722 is fitted into the sliding groove 61, the supporting base 721 is neighboring to a bottom surface of the sliding groove 61; in the present embodiment, the armrest rod 6 is formed as a hollow rod; the bottom surface of the armrest rod 6 is provided with an opening 610 through which the sliding block 722 is inserted into the sliding groove 61 and being limited within the sliding groove 61; the sliding block 722 comprises wings 7221 extending oppositely with respect to each other above the supporting base 721 towards a widthwise direction of the sliding groove 61; the sliding groove 61 comprises sliding rails 611 extending into the sliding groove 61 from two sides of the opening 610 to support the wings 7221; the wings 7221 are supported on the sliding rails 611 and slidable on the sliding rails 611; in the present embodiment, the armrest rod 6 is curved a middle portion thereof, such that the armrest rod 6 has an overall curve shape; surfaces of the supporting base 721 facing towards the wings 7221 are spaced apart from the wings 7221 respectively so that the sliding rails 611 are limited within the supporting base 721 and the wings 7221; the armrest rod 6 is slidable with respect to the position limiting portion 72 of the supporting piece 7, so that the armrest rod 6 can be smoothly rotated upwardly during folding and rotated downwardly from a folded position to an unfolded position during unfolding; two end surfaces of the armrest rod 6 are provided with end caps 62 which limit a stroke of the sliding block 722 sliding on the sliding rails 611 to prevent the sliding block 722 from sliding out of the sliding groove 61 of the armrest rod 6.

To fold the foldable chair frame during use, fold up the front cross rod assembly B and the rear cross rod assembly C, such that the upper ends of the two first branch rods 81 of the rear cross rod assembly C drive the rear connecting seats 51 on the backrest rods 1 to slide upwardly, while upward movements of the upper ends of the two second branch rods 91 of the front cross rod assembly B as a result of the front cross rod assembly B being folded up will also drive the sliders 42 at lower portions of the armrest supporting rods 4 to slide upwardly on the oblique supporting rods 2; upward displacement of the armrest supporting rods 4 due to upward movements of the sliders 42 will rotate the front end of the armrest rods 6 upwardly; to complete folding of the armrest rods 6, manually pull up the armrest rods 6 such that the sliding grooves 61 of the armrest rods 6 slide with respect to the position limiting portions 72 of the supporting pieces 7, until the armrest rods 6 are completed folded along with the armrest supporting rods 4 and the entire foldable chair frame, and therefore placed on one side of the backrest rods 1, thereby achieving folding of the armrest rods 6. On the contrary, to unfold the foldable chair frame, the two frames A are unfolded, and the armrest supporting rods 4 will be displaced downwardly; then press down the armrest rods 6 so that the armrest rods 6 slide with respect to the position limiting portions 72 of the supporting pieces 7 in a reverse direction so as to unfold the armrest rods 6 together with the foldable chair frame.

What is claimed is:

1. A foldable chair frame with armrests; wherein the foldable chair frame comprises two frames symmetrically to each other and arranged oppositely with respect to each other, one of which being a left frame of the foldable chair frame, and another one being a right frame of the foldable chair frame; a front cross rod assembly and a rear cross rod assembly are disposed between the two frames; the front cross rod assembly is pivotally connected to front parts of the two frames so as to be rotatable with respect to the two frames; the rear cross rod assembly is pivotally connected to rear parts of the two frames so as to be rotatable with respect to the two frames; each of the two frames comprises a backrest rod, an oblique supporting rod, a seat rod, and an armrest supporting rod, an upper end of the oblique supporting rod is pivotally connected with a rear connecting seat which is slidable on the backrest rod, a lower end of the armrest supporting rod is slidably connected to the oblique supporting rod, the seat rod is pivotally connected to both the backrest rod and the oblique supporting rod; wherein, an armrest rod is provided between each backrest rod and a corresponding armrest supporting rod disposed in front of the backrest rod;

in each of the two frames, a front end of the armrest rod is pivotally connected to an upper end of the armrest supporting rod, a rear end of the armrest rod is connected to a supporting piece, and the supporting piece is pivotally connected to the backrest rod and positioned below the rear connecting seat; a bottom side of the armrest rod is provided with a sliding groove, the supporting piece is provided with a position limiting portion slidably limited in the sliding groove, when the armrest rod is being folded or unfolded together with folding or unfolding operation of the foldable chair frame, the position limiting portion slides in the sliding groove.

2. The foldable chair frame of claim 1, wherein in each of the two frames, the supporting piece comprises a connecting portion and said position limiting portion disposed on one end portion of the connecting portion; the connecting portion is connected to the backrest rod by pivotal connection; the position limiting portion comprises a supporting base and a sliding block provided on the supporting base; the sliding block is fitted into the sliding groove of the armrest rod; when the sliding block is fitted into the sliding groove, the supporting base is neighboring to a bottom surface of the sliding groove.

3. The foldable chair frame of claim 2, wherein in each of the two frames, the armrest rod is formed as a hollow rod; a bottom surface of the armrest rod is provided with an opening through which the sliding block is inserted into the sliding groove and being limited within the sliding groove; the sliding block comprises wings extending oppositely with respect to each other above the supporting base towards a widthwise direction of the sliding groove; the sliding groove comprises sliding rails extending into the sliding groove from two sides of the opening to support the wings; the wings are supported on the sliding rails and slidable on the sliding rails.

4. The foldable chair frame of claim 3, wherein in each of the two frames, the armrest rod is curved at a middle portion thereof, such that the armrest rod has an overall curve shape; the sliding rails are limited within the supporting base and the wings.

5. The foldable chair frame of claim 2, wherein in each of the two frames, two end surfaces of the armrest rod are provided with end caps which limit a stroke of the sliding block sliding on the sliding rails.

6. The foldable chair frame of claim 1, wherein the rear cross rod assembly comprises two first branch rods arranged in a cross shape and pivotally connected to each other; the front cross rod assembly comprises two second branch rods arranged in a cross shape and pivotally connected to each other;

an upper end of each of the two first branch rods is pivotally connected to the rear connecting seat of a corresponding backrest rod; an upper end of each of the two second branch rods is pivotally connected to a front connecting seat;

and each front connecting seat is connected and to a corresponding armrest supporting rod of a corresponding frame; a front portion of each seat rod of each frame rests on a corresponding front connecting seat.

7. The foldable chair frame of claim 6, wherein an upper portion of each armrest supporting rod is bent outwardly to form a bent portion, and the bent portion is located above the corresponding front connecting seat.

8. The foldable chair frame of claim 6, wherein a lower portion of the oblique supporting rod of each of the two frames is provided with a slider slidably provided on the oblique supporting rod, and the slider is located on the oblique supporting rod at a position above a position on the oblique supporting rod pivotally connected to a lower end of a corresponding second branch rod, each slider comprises a U-shaped block, and the lower end of the corresponding armrest supporting rod is pivotally connected to the U-shaped block.

* * * * *